US006675847B2

(12) United States Patent
Noden

(10) Patent No.: US 6,675,847 B2
(45) Date of Patent: Jan. 13, 2004

(54) ADJUSTABLE HEIGHT WORKBENCH WITH FOOT PEDAL ACTUATED SAFETY DISENGAGING MECHANISM ON SUPPORT STANDARDS

(76) Inventor: Geoffrey Noden, 232 Stokes Ave., Trenton, NJ (US) 08638

( * ) Notice: Subject to any disclaimer, the term of this patent is extended or adjusted under 35 U.S.C. 154(b) by 0 days.

(21) Appl. No.: 10/216,692

(22) Filed: Aug. 12, 2002

(65) Prior Publication Data

US 2003/0106614 A1 Jun. 12, 2003

Related U.S. Application Data

(60) Provisional application No. 60/340,348, filed on Dec. 7, 2001.

(51) Int. Cl.[7] ..... B25H 1/16

(52) U.S. Cl. ..... 144/287; 144/286.5

(58) Field of Search ..... 144/286.1, 286.5, 144/287; 108/116, 144.11, 146, 147, 147.19; 269/289 R; 248/676, 125.8, 161

(56) References Cited

U.S. PATENT DOCUMENTS

| | | | | |
|---|---|---|---|---|
| 149,255 A | | 3/1874 | Semmendinger | |
| 1,650,293 A | | 11/1927 | Morey | |
| 1,687,128 A | | 10/1928 | Hall | |
| 1,802,362 A | | 4/1931 | Walter | |
| 1,888,478 A | | 11/1932 | Steidl | |
| 2,308,714 A | * | 1/1943 | Ralston | 248/423 |
| 2,353,064 A | | 7/1944 | Parham | |
| 4,545,463 A | * | 10/1985 | Olovsson | 187/244 |
| 5,197,393 A | * | 3/1993 | Yeakle | 108/10 |
| 5,289,782 A | * | 3/1994 | Rizzi et al. | 108/147 |
| 5,941,182 A | * | 8/1999 | Greene | 108/147 |

FOREIGN PATENT DOCUMENTS

| | | | |
|---|---|---|---|
| DE | 3438862 | * | 4/1986 |

* cited by examiner

*Primary Examiner*—Allen Ostrager
*Assistant Examiner*—Shelley Self
(74) *Attorney, Agent, or Firm*—William L. Muckelroy; Art Lessler; Gary Lipson

(57) ABSTRACT

A workbench with an adjustable height top dually engaged by twin standards with each standard having a single pawl-like structure laterally extended from front to back. The pawl mechanism in each standard is a laterally extended round rod engaging a vertical array of rounded ratchet apertures at the front and back end of the top. A novel safety mechanism to prevent inadvertent disengagement of the rod from the ratchet apertures is a combination of a tension spring connected between a chain and a foot actuator pedal. This spring prevents accidental release of the rod by absorbing unintentional or inadvertent minor force applied to the pedal. The rod-like structure or pawl provides superior structural rigidity for the bench when restricted with rear shims to rotation into the ratchet slots at an angle α between less than about 45 degrees and greater than about 10 degrees.

10 Claims, 5 Drawing Sheets

ADJUSTABLE HEIGHT WORKBENCH WITH FOOT PEDAL ACTUATED SAFETY DISENGAGING MECHANISM ON SUPPORT STANDARDS

PRIORITY DATE CLAIMED

A priority date of Dec. 7, 2001 is claimed based on filing of a provisional application in the U.S. of America, application serial No. 60/340,348 for this invention.

BACKGROUND OF THE INVENTION

1. Field of the Invention

This novel invention is related to mechanical improvements in adjustable height non-inclinable worktables used to support large heavy work objects during a process involving constructing, carving, sculpturing, and/or manufacturing.

2. Description of Prior Art

In 1874 Semmendinger was issued U.S. Pat. No. 149,255 for an improvement in camera stands. A camera stand platform was made readily adjustable to a particular height using a load-bearing lever with a roller at the platform support end connected to a manual pawl detent and ratchet assembly.

Morey et al. received U.S. Pat. No. 1,650,293 on Nov. 22, 1927 entitled "Hospital Furniture". The Morey et al. invention of the prior art relates to improvements in hospital furniture, and has for its primary object the provision of a bed side table, particularly adapted for use in hospitals, with which is combined an adjustable and collapsible shelf structure, of which the latter is of such form and mounting that when not in use the same may occupy a folded or collapsed position lying parallel and adjacent to one side of the table, and when in an active position may be extended so as to provide a support permitting the placing of articles, such as food trays and the like, thereon.

Another aspect of the prior art invention resides in the provision of a hospital table with which is combined a foldable shelf structure, and wherein the supporting means for the shelf structure includes a non-rotatable vertical standard slidably supported within fixed guides carried by the side of the table, and wherein the standard is provided with a plurality of ratchet teeth cooperative with a pivoted locking detent which serves to maintain the standard locked automatically in any of its elevated positions of adjustment, so that the shelf or ledge carried in connection with the standard may be positioned at any desired elevation necessary to suit the convenience of the patient, and to adapt the shelf structure either to project over the bed of a reclining patient, or to permit the lowering of the same for use when the patient is occupying a chair or to maintain the shelf in any desired horizontal plane of adjustment.

A further prior art aspect resides in the provision of a foot operated releasing means by which the detent may be removed from engagement with the teeth of the shelf supporting standard so as to allow the latter to be lowered to assume a folded or inactive position.

Another prior art aspect is providing the upper end of the standard with a bifurcated head to which is pivotally connected one end of the supporting shelf, in order that when the shelf is lowered the same will lie closely adjacent and parallel to the side of the table upon which it is mounted and when raised the shelf will be swung to assume a position perpendicular to the table, novel locking and releasing means being provided for maintaining the shelf in its extended or active position where the shelf lies in a horizontal plane substantially at right angles to the table.

Other aspects of the Morey et al. invention reside in the provision of a table of a character wherein the shelf structure may be raised, lowered and adjusted with convenience and facility, and wherein the locking mechanism is of a positive and automatic character, devoid of set screws and the like to the end of assuring the retention of the shelf structure in any desired position of adjustment.

Noteworthy of the applicant's novel invention is that the Morey et al. invention teaches away from any adaptation of its mechanism to a table top which is so heavy and massive compared to the mass of the standard that support of same in a horizontal position by a single standard cannot be achieved due to the center of gravity of the combined structure extending so much away from the standard as to cause it to tilt and fall over.

Likewise, Hall's U.S. Pat. No. 1,687,128, which issued on Oct. 9, 1928 for a combination stool, chair, and table discloses a horizontal surface supported with one (central) adjustable vertical standard with the surface area of the horizontal surface being variable. A cantilevered tray supported on one edge wherein the elevating and actuating is done with one foot is suggested and disclosed in the bedside table patented by Walter on Apr. 28, 1931 in U.S. Pat. No. 1,802,362. Walter's tray is not adapted for the support of substantial weight where the center of gravity of the table is such that it would readily tilt over.

On Nov. 22, 1932 Steidl received U.S. Pat. No. 1,888,478 for a combination table. Steidl, to enable easy adjustment of the table top and standard, counterbalanced it with a spring that he located inside a hollowed out standard, which centrally supported the top. For securing the table at various vertical heights, Steidl used a pawl and ratchet connection between the standard and a base. The ratchet was formed in or carried by the side of the standard and consisted of a set of upwardly faced pointed ratchet saw teeth. The saw teeth have at their supporting base surface abruptly shouldered seats on which the pawl rests. The pawl is a spring strip attached to the standard with the upper engaging end of the strip being the pawl in the form of a downwardly facing tooth or lug for engaging with the upwardly facing base of the ratchet teeth. The pawl is adapted with both engaging teeth and locking lugs in one unified structure and is utilized on only one vertical support surface of the standard.

On Jan. 19, 1943 U.S. Pat. No. 2,308,714 was granted to Ralston for an adjustable chair. It is noteworthy here because of its two vertical spaced apart support standards each of which employs a pawl and ratchet mechanism linked together via a single rod and lever mechanism for lowering and raising the chair using a pair of spring connected pawls for alternately engaging opposing rows of ratchets at each standard supporting the chair.

On Jul. 4, 1944 Parham was granted U.S. Pat. No. 2,353,064 for a beauty parlor stand wherein the improvement consisted of an adjustable single pedestal table top whereby implements placed thereon are all moved in closer proximity to a patron to save operator time.

On Dec. 19, 1967 U.S. Pat. No. 3,358,620 was granted to Italian inventor P. Parigi for a single tilted standard supporting a ratcheted and spring rotatable loaded worktable adapted as a drawing board.

OBJECTS OF THE INVENTION

It is a main object of the present invention to provide a heavy duty workbench capable of supporting work several times its weight at selected heights and further capable of moving and adjusting the work surface of the workbench up or down in small equal increments using a foot actuator improved with an interconnecting spring structure to avoid accidental disengagement.

It is another object of the present invention to provide a workbench having a height adjustable work surface using at least two manual and independent height adjustable standards.

It is yet another object of the present invention to provide a workbench with a height adjustable work surface, which can be tilted at both ends.

It is still another object of the present invention to provide a workbench wherein each standard is made of a pair of nesting inner and outer frames which together support one end of a workbench.

It is an object of the invention to provide a workbench wherein an inner support frame is locked at variably selected heights using a rounded pawl that disengageably engages one of a mating set of rounded ratchets.

It is another object of the invention to provide an adjustable height workbench top which is actuated using a foot pedal to generate a rotation of a rod, the rod being attached to the top and oriented parallel to the top, the rod acting as a pawl wherein the rod dually and simultaneously engages and/or disengages from a mating rounded ratchet arrayed in a vertical set of ratchets forming a part of two supporting standards.

SUMMARY OF THE INVENTION

One problem with the workbench structures of the prior art is that a structurally rigid heavy duty bench with an adjustable height top adapted to support several times the weight of the bench wherein the top is dually engaged by a single pawl-like structure has been heretofore unavailable. The pawl and ratchet mechanisms rely on individual pawls in each standard. These separated pawls do not structurally brace the workbench from one side to the other or provide integral support, relying instead on the top itself and separate bracing structures connected between the standards.

In the novel invention there is a vertical set of rounded ratchet slots or apertures which are engaged by a rod-like structure which extends from one edge of a standard to the other edge and which simultaneously engages the ratchet slots at the same height on each edge of the standard. In addition, a novel safety mechanism was discovered, designed and integrated into the workbench. This safety mechanism is a combination of a tension spring connected between a chain and a foot actuator pedal. It was discovered that this spring prevents accidental release of the rod by absorbing unintentional minor force applied to the pedal. Early prototypes would sometimes be inadvertently disengaged. Thus, the safety mechanism was incorporated into the novel workbench to prevent accidental disengagement from the supporting ratchet. Further, it was discovered that the rod-like structure (pawl) provides the best structural rigidity for the bench when rotated into the ratchet slots at an angle between less than 45 degrees and greater than about 10 degrees. Moreover, it was also discovered that when the rod-like pawl is combined with the mating round ratchet slots, wear is lessened compared to angulated ratchet slots or where a ledge or flat surface is formed on the rod as a point of engagement contact.

The rigidity of the bench and each standard is also improved by means of a novel locking action. This locking action or mechanism is a shim extension attached to a brace used at each side of the standard between an inner ratchet frame attached to the top of the bench and an outer frame, which rests on the floor. The shim extends between the back of the inner frame and the inner surface of the outer frame and presses and locks the ratchets on the inner frame against the ratchet engaging rod at each side of the inner frame. The angle formed by the line connecting the engaging rod axis and the rotating rod axis and horizontal is between about 10 degrees and 45 degrees.

BRIEF DESCRIPTION OF THE DRAWINGS

The above objects and other features, aspects, and advantages of the present invention will become better understood with regard to the following description, appended claims, and accompanying drawings wherein:

DESCRIPTION OF THE PREFERRED EMBODIMENT

Figure 1:
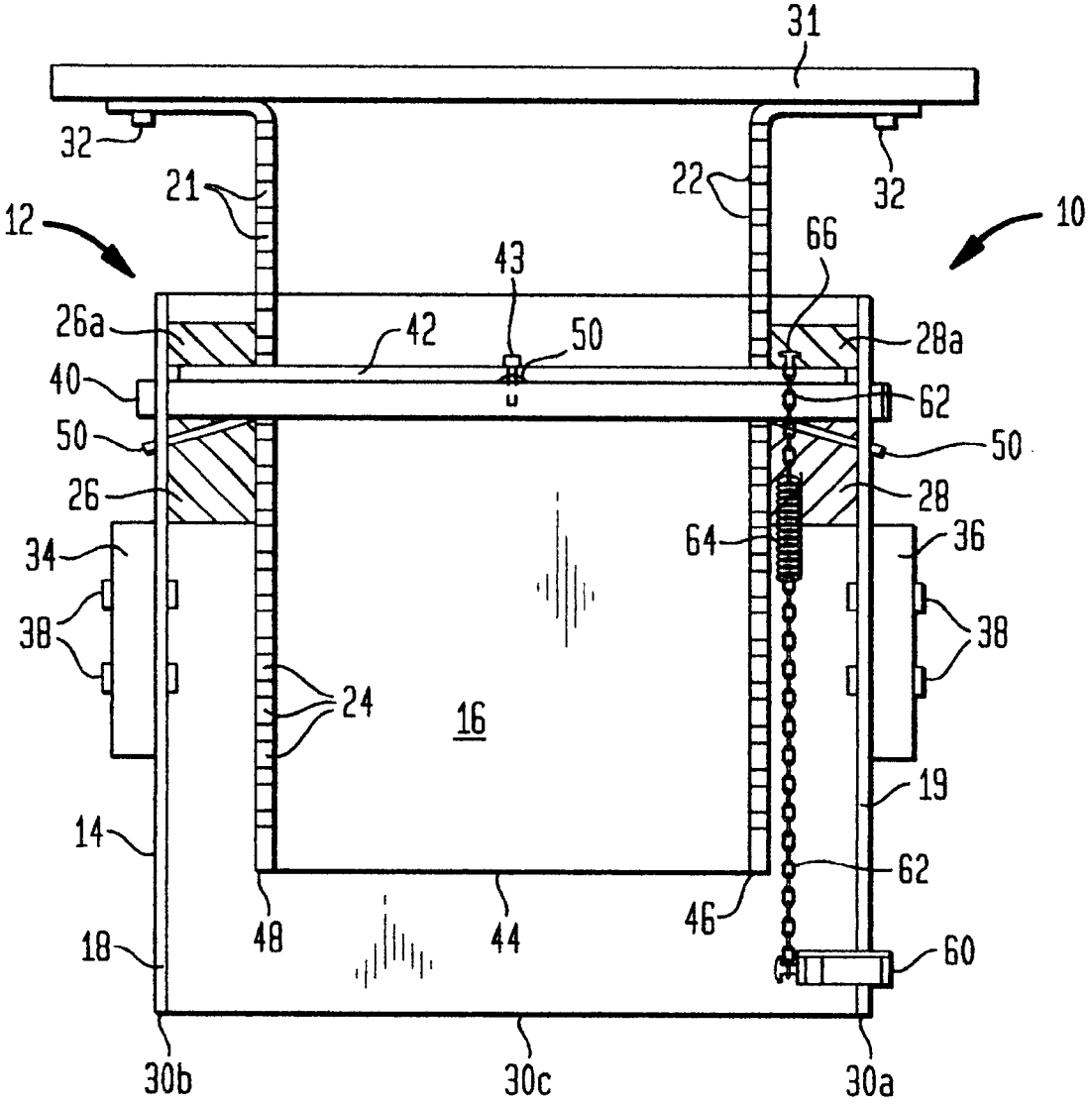
FIG. 1 illustrates both a right end view and a left end view of the novel workbench showing the parts of a standard braced with attached side rails and a top with a ratcheted support member.

In FIG. 1 there is shown a view of the identical left and right sides of a novel workbench 10. There is also shown one of two adjustable height supports, for example a left standard 12 shown in accordance with the novel invention. A right standard 13 (shown in FIG. 5) supports the top of the workbench 31. The standard 13 is a replica of the standard 12. The standard 13 bears the same like-numbered parts as the standard 12 detailed in FIG. 1.

Figure 2:
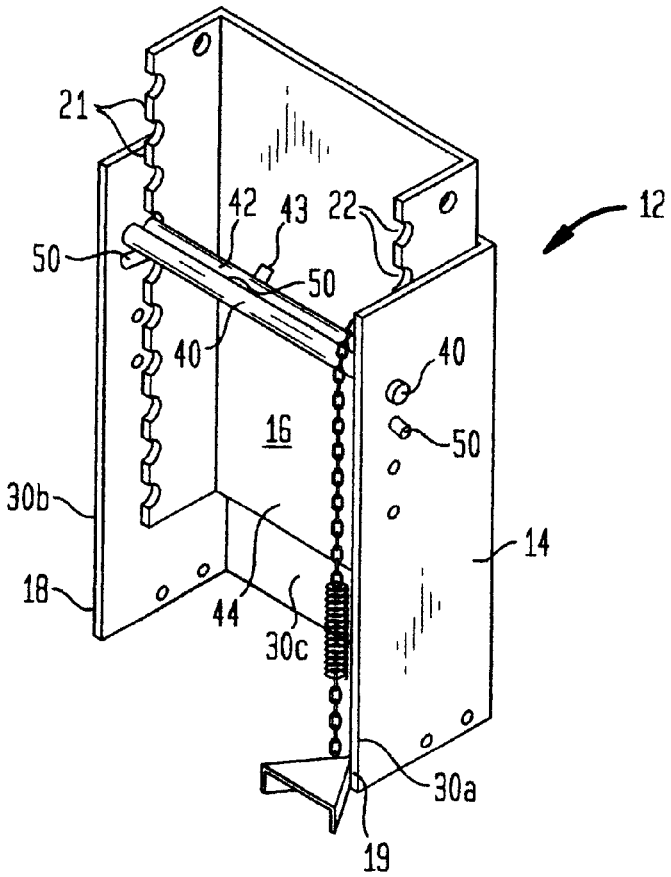
FIG. 2 illustrates both an assembled right standard and an identical assembled left standard.
Figure 4:
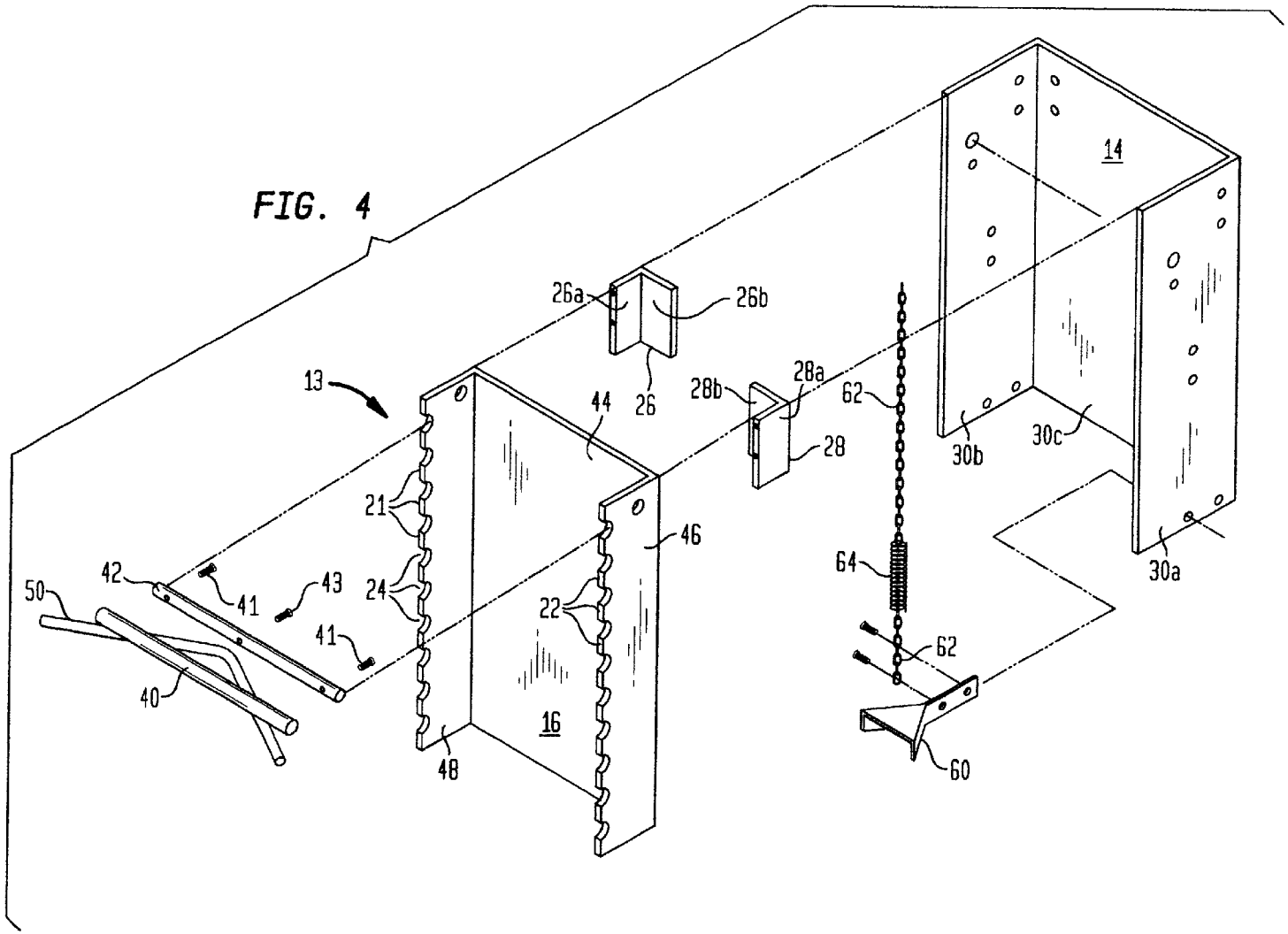
FIG. 4 is an exploded perspective view of the parts of the standard illustrated in FIG. 2.

As shown in FIGS. 1, 2 and 4 the standard 12 has outer vertical frame 14 with a bracket-shaped ([) cross-sectional plan view and an inner vertical frame 16 with a congruent bracket-shaped ([) cross-sectional plan view. The vertical frame 14 is made of steel or aluminum, for example, having a thickness of $\frac{3}{8}^{th}$ of an inch, for example. The vertical frame 14 has vertical edges 18 and 19. The inner vertical frame 16 has a right vertical panel 46 and a left vertical panel 48, each bearing equally spaced apart ratchets or sets of ratchet apertures 21 and 22 with teeth 24 wherein the apertures 21 and 22, and teeth 24 alternate to form an assembly of ratchets. The frame 16 is slidingly spaced and nested within the outer frame 14 by first and second spacers 26 and 28.

Figure 3:
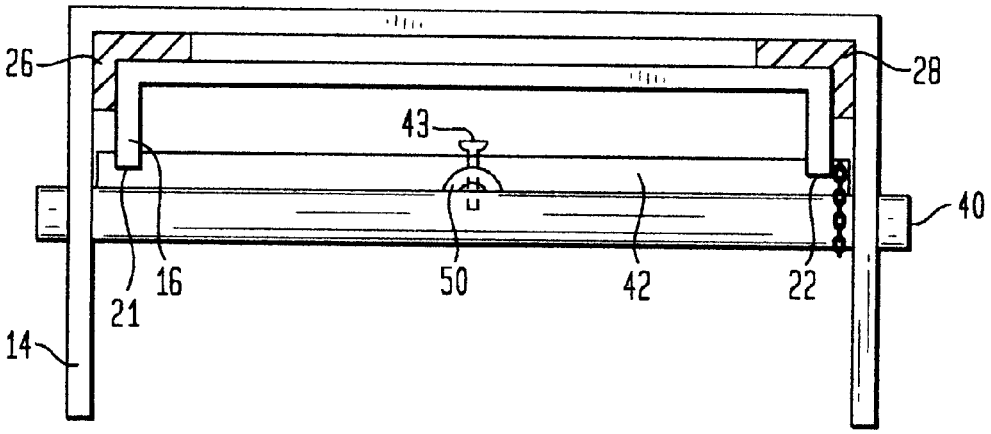
FIG. 3 is a top view of the standard shown in FIG. 2.

Referring to FIG. 3 there is a plan view which shows the spacers 26 and 28 are right angular solid pieces. In FIG. 4 further detail of the spacers 26 and 28 illustrates the spacers 26 and 28 are made of solid rectangular parts 26*a* and 28*a*, respectively, connected at right angles to relatively thin rectangular shims 26*b* and 28*b*, respectively.

The relatively thin rectangular shims 26*b* and 28*b* extend behind the inner frame 16 and between frames 14 and 16. The parts 26*a* and 28*a* are attached at a right narrow vertical sidewall 30*a* and a left narrow vertical sidewall 30*b*, respectively, which are parts of the outer bracket-shaped frame 14. As further shown in FIG. 4, the outer bracket-shaped frame 14 is made up of a vertical back wall 30*c* interconnecting the left narrow vertical side wall 30*b* and the right narrow vertical side wall 30*a*.

Shown in FIG. 1 is a top 31 attached to the standard 12 with bolts 32, for example. A front bracing rail 34 (or lateral front brace) and a back bracing rail 36 (or lateral back brace) are attached to the standard with bolts 38, for example.

Shown in FIG. 1, the inner frame 16 is indirectly supported by a horizontal rod 40 extending through the narrow vertical walls 30*a* and 30*b* of the outer frame 14. Actual direct support is provided by allowing the inner frame 16 to rest on the rod, which forms a pawl member 42. The pawl member 42 retractably rotatingly engages the two sets of ratchet apertures 21 and 22 at parallel positions. The pawl member 42 or rod retractably rotatingly engages the first ratchet aperture 21 located on an edge of the inner frame 16. The pawl member 42 or rod also retractably rotatingly engages the other corresponding ratchet aperture 22 located on another edge of the inner frame 16 at a corresponding parallel position.

Referring to FIG. 4, the inner frame 16 is formed by a rear vertical panel 44 connecting the right vertical panel 46 to the left vertical panel 48. The set of ratchet apertures 22 are located on the edge of the right vertical panel 46. The set of ratchet apertures 21 are located on the edge of the left vertical panel 48.

The pawl member 42 is a rod somewhat smaller in diameter than the rod 40 as illustrated in FIG. 2. Referring to FIG. 4, the pawl member 42 is affixed lengthwise to the horizontal rod 40 with threaded screws 41 and 43 extending transversely through and across the axis of the pawl member 42 and further extending threadedly into the horizontal rod 40.

Fully shown in FIG. 4 is a novel rotational biasing means for causing the pawl member 42 combined with the horizontal rod 40 in the manner shown to rotate about the axis of the rod 40 toward the ratchets 21 and 22. The pawl member 42, i.e. a rod, is engaged by teeth 24 (FIG. 1) and thereby retained with the assistance of a force applied by the piano wire 50 fixedly engaged between the rod 40 and the pawl member 42 by a threaded screw 43, for example, centrally located in the pawl member 42.

The rotational biasing means comprises a wire 50, namely, a length of rigid high tensile strength wire such as large gauge piano, for example. As illustrated in FIGS. 1 and 2, the piano wire 50 has a bend at its center point about the screw 43. The piano wire 50 has one end rigidly fixed in an aperture in the wall 30*b* and the other end rigidly fixed in an aperture in the wall 30*a*. The piano wire 50 is twisted or bent toward the inner frame 16 as a part of a means for pressing and locking the pawl member 42 into a selected ratchet at a selected height in the set of ratchets 21 and into a corresponding ratchet at the same height in the set of ratchets 22.

In FIG. 4 is shown a novel safety mechanism comprising a foot pedal 60, chain 62, and spring 64 connected as shown with one mechanism incorporated into each of the standards 12 (FIG. 2) and 13. Two of these safety mechanisms are used conjunctively to prevent inadvertent removal of the ratchet support for the workbench top 31 (FIG. 1). The safety mechanism is connected to the rod 40. The mechanism connects via a screw 66 (FIG. 1) fixedly threaded into the side of the rod 40 and extending through a link of the chain 62, which interconnects the screw 66 to a top end of the spring 64. Shown in FIG. 4, another length of the chain 62 interconnects a bottom of the spring 64 to a screw in the foot pedal 60.

Figure 5:
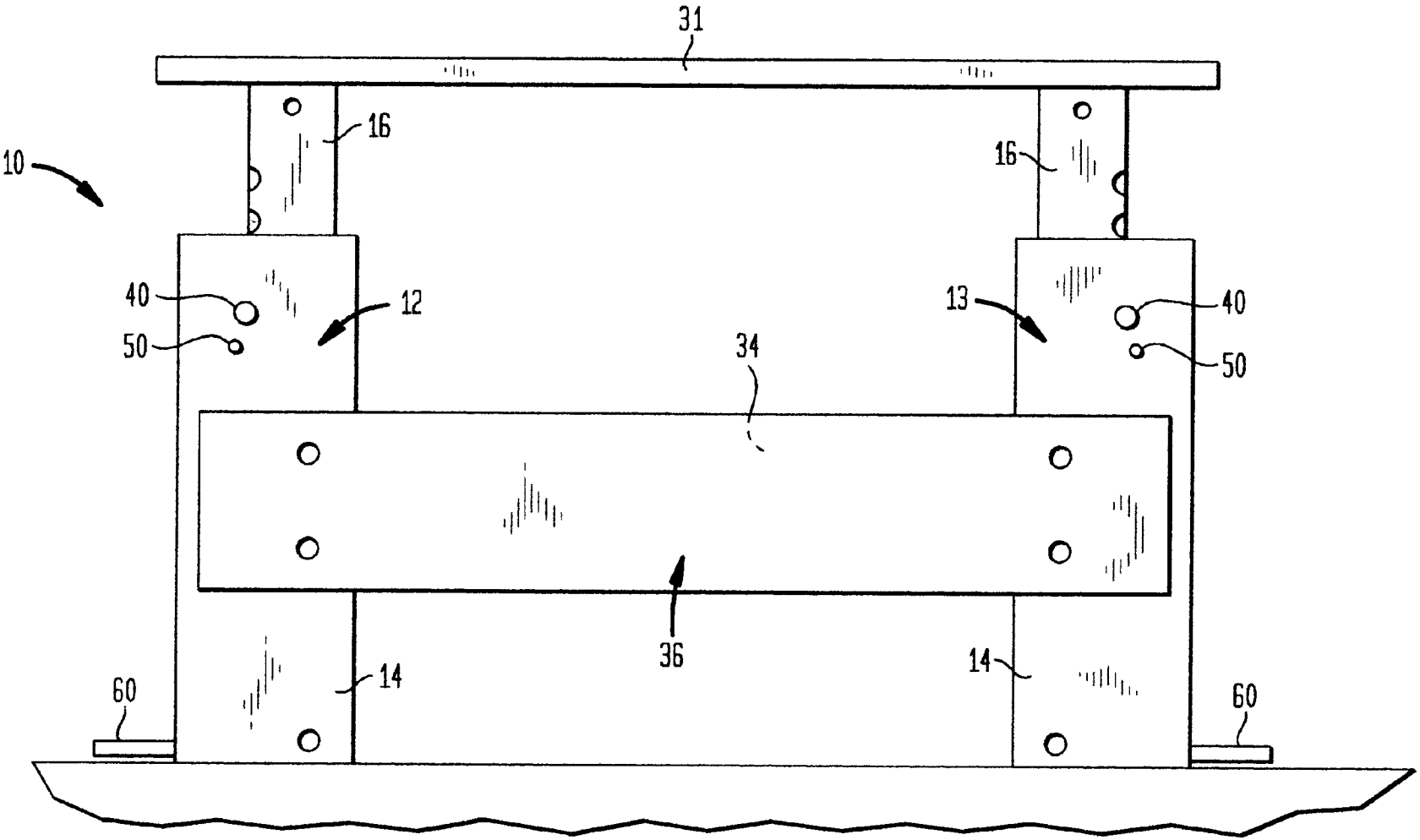
FIG. 5 is a front view of a complete assembly of the novel workbench showing a bracing member connected between the standards; and, FIG. 6 is a cut-away magnified detailed view of the rod and ratchet assembly and piano wire spring and shim in each standard.

A side view of the novel bench 10 with left and right standards 12 and 13 supporting the top 31 is shown in FIG. 5. There is shown the lateral front brace or rail 34 bolted to left and right standards 12 and 13. Foot pedals 60 are shown extending from the standards 12 and 13.

Figure 6:
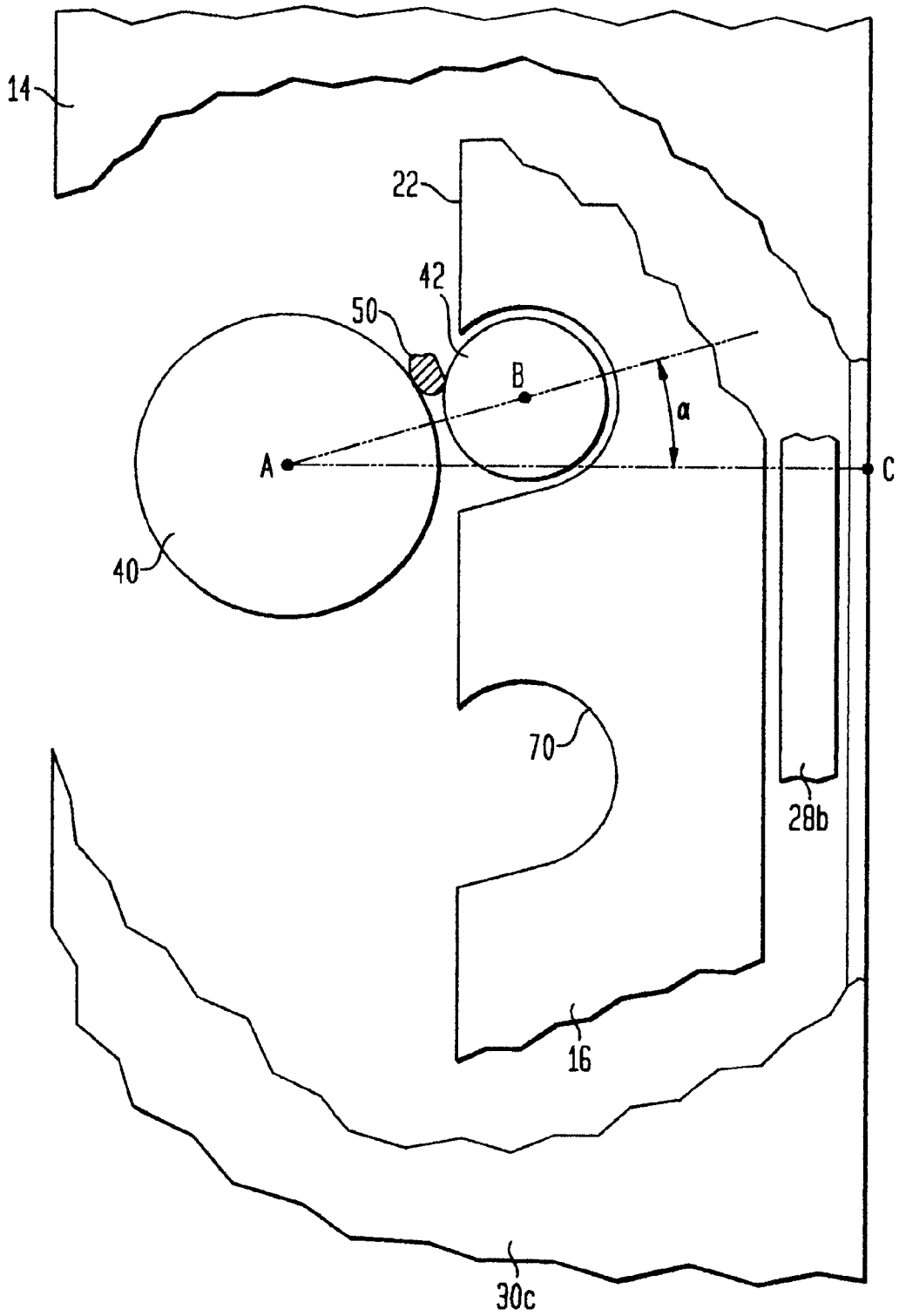

A detailed view of the end structure inside the standard 14 is shown in FIG. 6. An end of the rod 40 is shown with its center A aligned with a lateral point C on the standard 14. An end of the rod forming the pawl member 42 is shown having a round cross-section and a center B. The rod 40 is separated and spaced away from the pawl member 42 by two parts of the wire 50 bent between them.

Shown in FIG. 4, the wire 50 is bent and extended around the screw 43. The screw 43 and screws 41 extend through the pawl member 42 and into the rod 40 firmly holding the wire 50. In FIG. 6, a line A–B and a line A–C form an angle $\alpha$ representing the angular rotation of the center of the pawl member 42 from a horizontal plane through which extends the line A–C. Shown also is the ratchet assembly comprised of the apertures 21 and teeth 24 (FIG. 4). The apertures 21 are formed of a curved rounded edge 70 in the inner frame 16 (FIG. 6). The edge 70 is formed and sized to matingly receive the rounded surface of the pawl member 42.

The height of the workbench 10 is raised by pulling up the inner vertical frame 16. As the frame 16 is raised the pawl member 42 is rotated out of one of the apertures 21. To lower the workbench 10, when the foot pedals 60 shown in FIG. 5 are sufficiently depressed the top of the workbench is raised slightly simultaneously to allow the pawl member 42 to disengage from the vertical frame 16. The frame 16 revolves about the rod 40 into another one of the apertures 21 by a spring action of the piano wire 50 whereby the angle $\alpha$ is preferably between less than about 45 degrees and greater than about 10 degrees. When the angle $\alpha$ is maintained in this range the inventor has determined that this provides the greatest support and ease of disengagement and re-engagement of the pawl member 42. One way the angle $\alpha$ is set to within this range is by selecting or adjusting the thickness of the member 28*b* used to separate the back of the vertical frame 16 from the outer vertical frame 14.

It will be apparent to those skilled in the art that various changes may be made to the embodiment presented herein by using equivalent mechanical means without departing from the scope of the invention; and therefore, the invention is not to be limited to what is described in the specification and shown in the drawings, but only as indicated in the appended claims and their equivalents in accordance with the doctrine of equivalents.

Parts List

Workbench 10
left standard 12
right standard 13
outer vertical frame 14
inner vertical frame 16
left vertical edge 18
right vertical edge 19
ratchet apertures 21
teeth 24
ratchet apertures 22
first spacer 26
second spacer 28
solid rectangular part 26*a*
solid rectangular part 28*a* thin rectangular shim 26*b*
thin rectangular shim 28*b*
right narrow vertical sidewall 30*a*
left narrow vertical sidewall 30*b*
vertical back wall 30*c*
top 31
bolts 32
front bracing rail 34
back bracing rail 36
standard bolts 38
horizontal rod 40
threaded screws 41
pawl member 42
threaded screw 43
rear vertical panel 44
right vertical panel 46
left vertical panel 48
piano wire 50
foot pedals 60
chain 62
spring 64
screw 66
rounded edge 70
center A
point C
center B
line A–B
line A–C
angle $\alpha$

What is claimed is:

1. An adjustable standard for a workbench having a height adjustable top comprising first and second support means each oriented in an upright position, the second support means having second left and second right sides, and a set of left ratchet slots located on the second left side and a set of right ratchet slots located on the second right side, the right ratchet slots being aligned with the left ratchet slots, each ratchet slot having a ratchet aperture, each ratchet aperture being rounded to engage a ratchet engaging means having a rounded cross-section, the first support means and the second support means each having an interior and an exterior, the second support means located concentrically inside said first upright support means, the second support means being slidably located in the interior of said first upright support means, a left brace member means for shimming and bracing the exterior and second left side of said second support means against the interior of said first support means, a right brace member means for shimming and bracing the exterior and second right side of said second support means against the interior of said first support means, a rotational means for rotatably pressing simultaneously said ratchet engaging means selectively against each set of ratchet slots which upwardly and downwardly adjusts the top of the work bench, said rotational means being attached to said ratchet engaging means for engaging simultaneously a ratchet slot from each set of ratchet slots.

2. In a workbench having a front and a back and comprising a top supported by a first standard having a first right side and a first left side and a second standard having a second right side and a second left side, the first right side of the first standard and the second left side of the second standard being bracingly interconnected by a first bracing member, the first left side of the first standard and the second right side of the second standard being bracingly interconnected by a second bracing member, the workbench having a ratchet means for manually adjusting the top upward and downward, the improvement comprising the first and second standards being height adjustable, the first and second standards each comprising first and second support means for supporting the top, each oriented in an upright position, two of the second support means being attached in a spaced apart relationship to the top, the second support means having second left and second right sides, the second support means further having a set of left ratchet slots located on the second left side and a set of right ratchet slots located on the second right side, the right ratchet slots being aligned with the left ratchet slots, the first support means and the second support means each having an interior and an exterior, a second support means located concentrically inside each said first upright support means, a second support means being slidably located in the interior of each said first upright support means, a left brace member means for shimming and bracing the exterior and left side of each said second support means against the interior of each said first support means, a right brace member means for shimming and bracing the exterior and second right side of each said second support means against the interior of each said first support means, and a rotational means for rotatably pressing simultaneously a rod-like ratchet engaging means against each set of ratchet slots, the rachet slots being rounded and adapted to matingly receive the rod-like ratchet engaging means, said rotational means being attached to said ratchet engaging means for engaging simultaneously a ratchet slot from each set of ratchet slots.

3. In a work bench having a front and a back, the work bench comprising a top supported by a first standard having a first right side and a first left side, the top further being supported by a second standard having a second right side and a second left side, the first right side of the first standard and the second left side of the second standard being located on the front, and the first left side of the first standard and the second right side of the second standard being located on the back, the first right side of the first standard and the second left side of the second standard being bracingly interconnected by a first bracing member, the first left side of the first standard and the second right side of the second standard being bracingly interconnected by a second bracing member, the work bench having a ratchet means for manually adjusting the top upward and downward, the improvement comprising the first and second standards being adjustable, the first and second standards each comprising first and second support means for supporting the top, each oriented in an upright position, two of the second support means being attached in a spaced apart relationship to the top, each of the two second support means having a second support means left side and a second support means right side, the second support means further having a set of left rachet slots located on the second support means left side and a set of right rachet slots located on the second support means right side, the right ratchet slots being aligned with the left ratchet slots, the first support means and the second support means each having an interior and an exterior, a second support means located concentrically inside each said first upright support means, one of said second support means being slidably located in the interior of each said first upright support means, a left brace member means for shimming and bracing the exterior and the second support means left side of each said second support means against the interior of each said first support means, a right brace member means for shimming and bracing the exterior and the second support means right side of each said second support means against the interior of each said first support means, and a rotational means for rotatably pressing simultaneously a ratchet engaging means against each set of ratchet slots, said rotational means being attached to said ratchet engaging means for engaging simultaneously a ratchet slot from each set of ratchet slots, wherein the rotational means for rotatably pressing simultaneously said ratchet engaging means against each set of ratchet slots comprises two arcuate lengths of stiff wires, one of each connected to the first support means left side and to the first support means right side of each of the first support means, the wires each having one bend at their centers, each ratchet engaging means for engaging simultaneously a ratchet slot from each set of ratchet slots comprises, two first cylinders, one of each first cylinders being connected to the left and right sides of each of the first support means and axially rotatable relative to said first support means, each ratchet engaging means further comprising two second cylinders, one attached to each of said first cylinders to laterally disengageably engage a set of ratchets on one of the second support means, the bend in one stiff wire being rigidly affixed between one pair of first and second cylinders and the other bend in the other stiff wire being rigidly affixed between the other pair of first and second cylinders.

4. The improvement in the work bench of claim 3 further comprising a ratchet disengaging means for disengaging one of said second cylinders from one of said sets of ratchets.

5. The improvement in the work bench of claim 4 wherein the ratchet disengaging means comprises an actuatable lever connected via a chain to said second cylinder and further having means for revolving said second cylinder about said first attached cylinder and for revolving said second cylinder away from an engaged set of ratchets.

6. The improvement in the work bench of claim 5 further comprising means attached to said second cylinder for preventing inadvertent disengagement of the second cylinder from an engaged set of ratchets.

7. The workbench according to claim 1 wherein the ratchet engaging means is a horizontal member extending from the first set of ratchets to the second set of ratchets.

8. The workbench according to claim 7 wherein the horizontal member has two portions, each portion having a rounded cross-section for engaging each ratchet aperture.

9. The workbench according to claim 8 wherein each ratchet aperture substantially receives each portion of the horizontal bar having a rounded cross-section.

10. The work bench according to claim 9 wherein the first support means comprises an outer frame having a right side and a left side and the second support means comprises an inner frame, and the work bench further comprising a horizontal rotating bar extending from the right side of the outer frame to the left side of the outer frame, the horizontal member being attached in parallel relationship to the horizontal rotating bar, a curved length of wire fixedly engaged at two separate equilateral points between the horizontal member and the horizontal rotating bar wherein the horizontal member revolves around the horizontal rotating bar and engages two lateral ratchet apertures.

* * * * *